US011738554B2

(12) United States Patent
Wang et al.

(10) Patent No.: US 11,738,554 B2
(45) Date of Patent: Aug. 29, 2023

(54) ROTATING MANIFOLDS

(71) Applicant: Hewlett-Packard Development Company, L.P., Spring, TX (US)

(72) Inventors: Deyang Wang, Singapore (SG); Adnil San Dela Pena Sazon, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/288,527

(22) PCT Filed: Jun. 7, 2019

(86) PCT No.: PCT/US2019/035947

§ 371 (c)(1),
(2) Date: Apr. 24, 2021

(87) PCT Pub. No.: WO2020/246983

PCT Pub. Date: Dec. 10, 2020

(65) Prior Publication Data

US 2022/0111644 A1 Apr. 14, 2022

(51) Int. Cl.
*B41J 2/14* (2006.01)
*B41J 2/175* (2006.01)

(52) U.S. Cl.
CPC ..... *B41J 2/14* (2013.01); *B41J 2/17596* (2013.01); *B41J 2002/14419* (2013.01)

(58) Field of Classification Search
CPC ..... B41J 2/175; B41J 2/185; B41J 2/17596; B41J 2/14; B41J 2002/1853; B41J 2002/14419
See application file for complete search history.

(56) References Cited

U.S. PATENT DOCUMENTS

| | | | |
|---|---|---|---|
| 5,102,084 | A | 4/1992 | Park |
| 6,003,981 | A | 12/1999 | Cameron et al. |
| 6,155,678 | A | 12/2000 | Komplin et al. |
| 6,270,204 | B1 | 8/2001 | Barrett et al. |
| 6,367,918 | B1 | 4/2002 | Heiles et al. |
| 9,132,228 | B2 | 9/2015 | Yan |
| 9,132,649 | B2 | 9/2015 | Petersen et al. |
| 2013/0293637 | A1 | 11/2013 | Bacon et al. |
| 2019/0091682 | A1 | 3/2019 | Drews et al. |
| 2020/0316950 | A1 | 10/2020 | O'Reilly et al. |

FOREIGN PATENT DOCUMENTS

| | | | |
|---|---|---|---|
| CN | 103328216 | A | 9/2013 |
| CN | 203510980 | U | 4/2014 |
| CN | 107000439 | A | 8/2017 |
| CN | 109311326 | A | 2/2019 |
| CN | 109580292 | A | 4/2019 |
| WO | WO-2016048270 | A1 | 3/2016 |

OTHER PUBLICATIONS

EPSON 1400 Continuous Ink System Install CISS.

*Primary Examiner* — An H Do
(74) *Attorney, Agent, or Firm* — Brooks, Cameron & Huebsch, PLLC

(57) ABSTRACT

The present specification describes a manifold for a fluid ejection system. The manifold includes a rotational connector on a first side surface, a plurality of pen interconnects on a bottom surface of the manifold, and a sliding surface on a top surface of the manifold. The sliding surface is to accommodate a fluidic interface. Sliding the fluidic interface along the sliding surface extends needles from the fluidic interface through the plurality of pen interconnects into a plurality of pens.

20 Claims, 10 Drawing Sheets

300

ROTATING MANIFOLDS

BACKGROUND

In some markets, there has been an increase in demand for Continuous Ink Supply System (CISS) fluid ejection systems. Continuous Ink Supply Systems (CISS) fluid ejection systems may include relatively large reservoirs of printing fluid (e.g., ink), which reservoirs are fluidically connected to pens. The pens perform the printing operation and contain a lesser amount of printing fluid.

BRIEF DESCRIPTION OF THE DRAWINGS

The accompanying drawings illustrate various examples of the principles described herein and are a part of the specification. The illustrated examples do not limit the scope of the claims.

Figure 1:
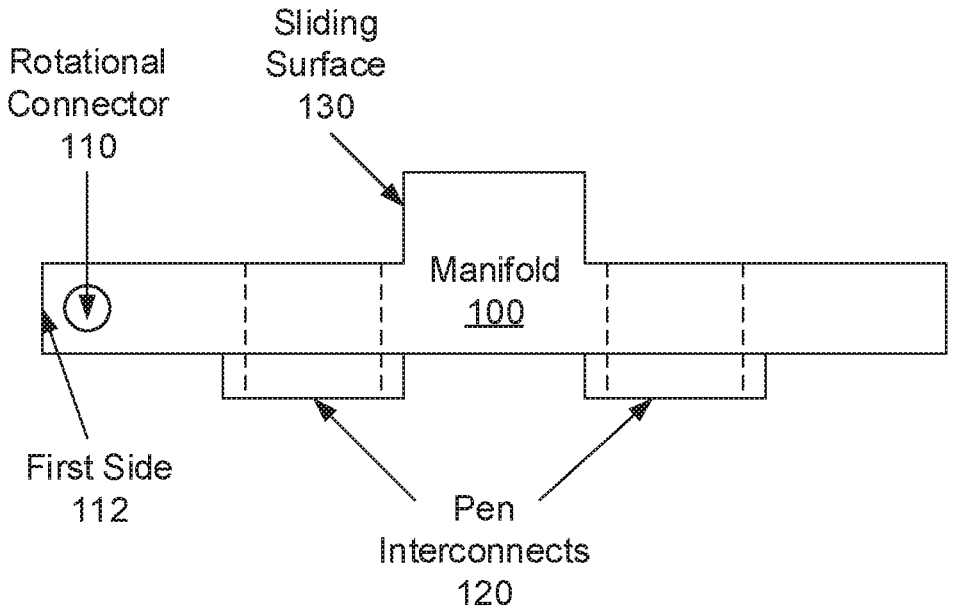
FIG. 1 shows a profile view of an example manifold for a fluid ejection system consistent with this specification.

Throughout the drawings, identical reference numbers designate similar, but not necessarily identical, elements. The figures are not necessarily to scale, and the size of some parts may be exaggerated or minimized to more clearly illustrate the example shown. The drawings provide examples and/or implementations consistent with the description. However, the description is not limited to the examples and/or implementations shown in the drawings.

DETAILED DESCRIPTION

Continuous Ink Supply Systems (CISS) fluid ejection systems include relatively large reservoirs of printing fluid (e.g., ink), which reservoirs are fluidically connected to pens. The pens perform the printing operation and contain a lesser amount of printing fluid. In some examples, the pens may be modified from disposable pens used in non-CISS fluid ejection systems. In other examples, the pens may be the same as the disposable pens. In practice, it is useful to increase the quality of the pens due to the number of ejection cycles the pens will experience. That is, over time, pens deteriorate in their ability to accurately and reliable eject the printing fluid. That is, because the pens may be a point of failure and in some examples are not replaced at periodic intervals, the pen quality is a factor for system life. Replacing the pens on a CISS fluid ejector system may be more challenging than on a system with disposable pens, due to the fluid connection between the fluid reservoir of the CISS system and the pen.

Accordingly, to transfer the fluid between the reservoir and the pens, a manifold may be used. In some examples, the manifold interfaces with a fluidic interface (FI) which connects the printing fluid reservoirs to the pens.

In general, another feature valued in printing systems is small size, which may include a smaller width, length, and/or depth. A smaller size allows the printing system to be placed in smaller areas and thereby to occupy less desk and/or floor space. A smaller size device may also reduce shipping and storage costs.

One of the size constraints for a printing system with a CISS is an amount of space needed for loading the pens into the system. For example, it may be desirable to load the pens at the customer site and/or at a display location rather than at a factory. This avoids the risk of the pens leaking printing fluid, being damaged, and/or other undesirable outcomes of shipping the system with the pens preinstalled.

Installing the pens may include gaining access to the area underneath the manifold and/or a fluidic interface. The pen may then be inserted through an opening and into the location underneath the manifold. Such a process may be complex and time-intensive, specifically when performed at a customer site by a customer who may not be familiar with the printing system. The pen may include a portion designed to be penetrated by the fluidic interface. In an example, this is a silicone or flexible plastic portion which is penetrated by the needle.

Accordingly, the present specification describes using a manifold with a rotational connector. Doing so allows the manifold to rotate out of the way to allow the pens to be installed. The manifold then rotates back and secures the pens in their locations. This alleviates the need to preinstall the pens.

However, mounting the fluidic interface to such a rotating manifold has the potential to cause the needles of the fluidic interface to enter the pen at an angle and while rotating. This many produce a larger opening in the pen than is desired, making it difficult to maintain pressure in the pen and/or allowing printing fluid to leak from the pen.

Accordingly, the present manifold, in order to improve the pen reliability, the pen latching and fluidic interface latching, decouples these operations into two steps as per existing CISS printers design to prevent some known pen issues like ink drooling, air leak into tubes . . . etc. The present manifold also enhances retailer shipment logistics (i.e., shipment of printer after start-up at retailer site).

Specifically, the present disclosure solves this issue by separating the fluidic interface interaction with the pen from the rotation of the manifold. Specifically, the manifold is first rotated into place to secure the pens. The fluidic interface is then slid vertically down onto the pens to connect the CISS to the pens. In this way, the smaller footprint achieved with a rotational connection on the manifold is compatible with minimized opening size between the fluidic interface and the pens. The result is a fluid ejection system with a reduced size, especially in depth, which is able to use the body portion of an existing fluid ejector system and support a CISS fluidic interface on top.

Among other examples, this specification describes a manifold for a fluid ejector system, the manifold includes a rotational connector on a first side; a plurality of pen interconnects on a bottom of the manifold; and a sliding surface on a top of the manifold, the sliding surface to accommodate a fluidic interface. Sliding the fluidic interface on the sliding surface extends needles from the fluidic interface through the plurality of pen interconnects into a plurality of pens.

Among other examples, this specification also describes a method of preparing a Continuous Ink Supply System (CISS) ejector system for use, including: sliding a fluidic interface vertically down onto a manifold until the fluidic interface locks into place, wherein sliding the fluidic interface includes passing needles into pens below the fluidic interface. The fluidic interface is slid along the sliding surface. This moves the fluidic interface vertically, down onto the manifold. The second latch holds the fluidic interface in place against the manifold. As part of the slid, a needle penetrates a pen and the valve in the needle opens to allow fluid printing fluid to pass from the reservoir to the pen.

This specification also describes a method of preparing a CISS ejector system for use, including: loading a pen underneath a pivoted manifold; pivoting the manifold down to secure the pen; latching the manifold in place with a first latch; and sliding a fluidic interface vertically down on the manifold such that a needle on the fluidic interface penetrates the pen.

Also described is a system for unlatching a manifold comprising: a carriage base; the manifold attached to the carriage base by a first latch; a fluidic interface connected to the manifold by a second latch, wherein actuating a release for the first latch releases the second latch prior to releasing the first latch.

Turning now to the figures, FIG. 1 shows a profile view of an example manifold (100) for a fluid ejector system consistent with this specification. The manifold (100) includes a rotational connector (110) on a first side (112), a plurality of pen interconnects (120) on a bottom of the manifold (100), and a sliding surface (130) on a top of the manifold (100), which the sliding surface (130) accommodates a fluidic interface. Sliding the fluidic interface along the sliding surface (130) extends needles from the fluidic interface through the plurality of pen interconnects (120) into a plurality of pens.

The manifold (100) of the system retains the pens in place. As described above, the manifold (100) rotates about the rotational connector (110). That is, the rotational connector (110) allows the manifold (100) to rotate out of position in order to allow loading of the pens into the printing system. This allows a larger access area compared with manifolds (100) lacking a rotational connector (110).

The rotational connector (110) may allow separation between the manifold (100) and the fluid ejection system. In an example, the rotational connector (110) is a pivot. Specifically, in an example, the rotational connector (110) is a hinge. As another specific example, the rotational connector (110) is a pivot which includes two pins extending from opposite sides of the manifold (100), the two pins sharing an axis of rotation, which axis of rotation may be part of the printing system. In another example, the manifold (100) has a pair of pins which snap into a C-shaped connection to form the rotational connector (110). In yet another example, the manifold (100) has a single pin which forms an axis of the rotational connector (110). The single pin may snap into place on the manifold (100) and fluid ejection system. The manifold (100) may have a U-shaped feature, allowing the manifold (100) to rotate around the axis of rotation. The rotational connector (110) may be a hinge formed from a slot and an associated tab. The rotational connector (110) may be a living hinge.

Figure 2:
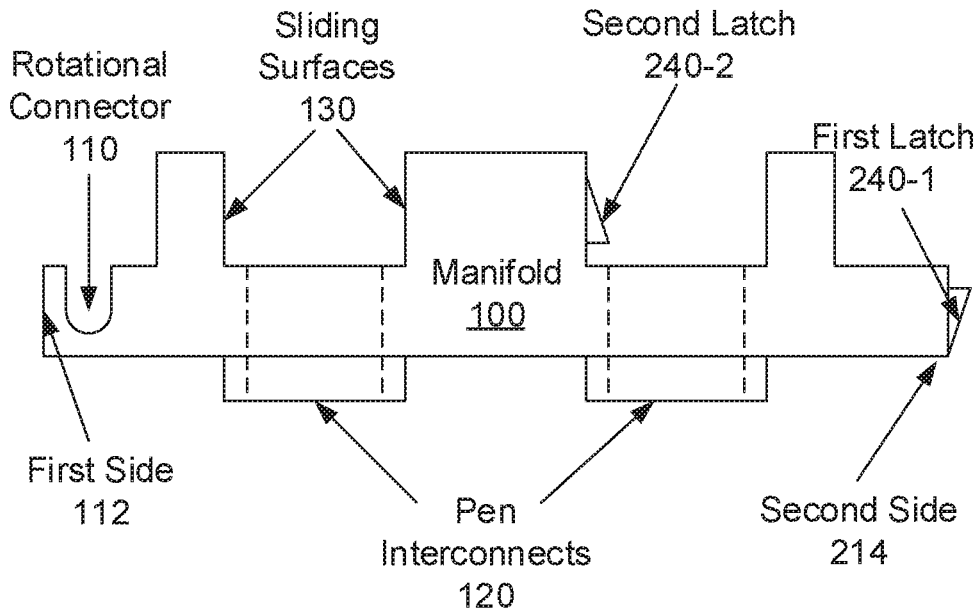
FIG. 2 shows a profile view of an example manifold for a fluid ejector system consistent with this specification.

The rotational connector is located on a first side (112) of the manifold (100). In an example, the first side (112) is opposite a second side, which second side includes a first latch as depicted in FIG. 2.

The pen interconnects (120) are to receive the pens inserted therein and in some cases provide features to stabilize the positions of the pens in the fluid ejection system. The pen interconnects (120) include openings passing through the manifold (100). The openings allow the fluidic interface to connect to the pens when the fluidic interface is slid down the sliding surface (130). While any number of pen interconnects (120) may be used, in one particular example four pen interconnects (120) are present on the manifold (100), one pen interconnect (120) for black ink and three pen interconnects (120) for other printing fluids.

The sliding surface (130) is located on a top surface of the manifold (100). The sliding surface (130) orients and stabilizes the fluidic interface as the fluidic interface slides down the sliding surface (130). The sliding surface (130) may include multiple surfaces, for example, the sliding surface may include a corner and/or other features to orient and/or limit the range of motion of the fluidic interface when sliding on the sliding surface (130).

The manifold (100) may further include a handle. The handle may allow a user to rotate the manifold (100) up and to apply force to latch the manifold (100) in place over the pens, thus simplifying fluid interface connection.

The needle which passes through the manifold into the pen may include an internal valve. The internal valve opens when the needle is pushed down into place. When the needle retracts, for example, as the fluidic interface is unlatched and moved upward, the valve may close. In this manner, ejection fluid may be controlled between the reservoir and the associated pen.

FIG. 2 shows a profile view of an example manifold (100) for a fluid ejector system consistent with this specification. The manifold (100) includes a first side (112) having a rotational connector (110) and a second side (214) having a first latch (240-1). The manifold (100) also has a bottom surface having a plurality of pen interconnects (120) and a top surface having multiple sliding surfaces (130) and a second latch (240-2).

The first latch (240-1) secures the manifold (100) against the pens below. The pen interconnects (120) may contact the pens to hold the pens adjacent the manifold (100). In some examples, the first latch (240-1) includes a spring such that when the first latch (240-1) is released, the spring pushes the second side of the manifold away from the body of the fluid ejection system. If this happens with the fluidic interface latched onto the manifold (100) the needles may damage the pens, creating a larger opening which allows weeping of printing fluid and/or other issues.

The second latch (240-2) retains and/or secures the fluidic interface against the manifold (100). The second latch (240-2) may include a spring which, when the second latch (240-2) is released, causes the fluidic interface to move away from the manifold (100) on the sliding surfaces (130).

In order to avoid user error from rotating the manifold (100) without undoing the second latch (240-2), in some examples, the release for the first latch (240-1) automatically releases the second latch (240-2). The release for the first latch (240-1) may release the second latch (240-2) prior to releasing the first latch (240-1) to provide time for the needles to retract prior to rotation of the manifold (100) about the rotational connector (110). The release on the first latch (240-1) may include an intermediate stop and/or other feature to slow sliding of the first latch (240-1).

Releasing the second latch (240-2) may block ejection fluid from moving from a reservoir to the associated pen interconnect (120). For example, the spring which separates the fluidic interface from the manifold (100) may also press a bar across the fluidic connections of the fluidic interface. In some examples, releasing the second latch (240-2) reduces pressure on the fluidic interface conduits and/or reservoirs for the CISS to cause the printing fluid to pull back into the fluidic interface. This may reduce leakage during equipment when the latches (240) are opened to perform maintenance and/or other activities.

Figure 3:
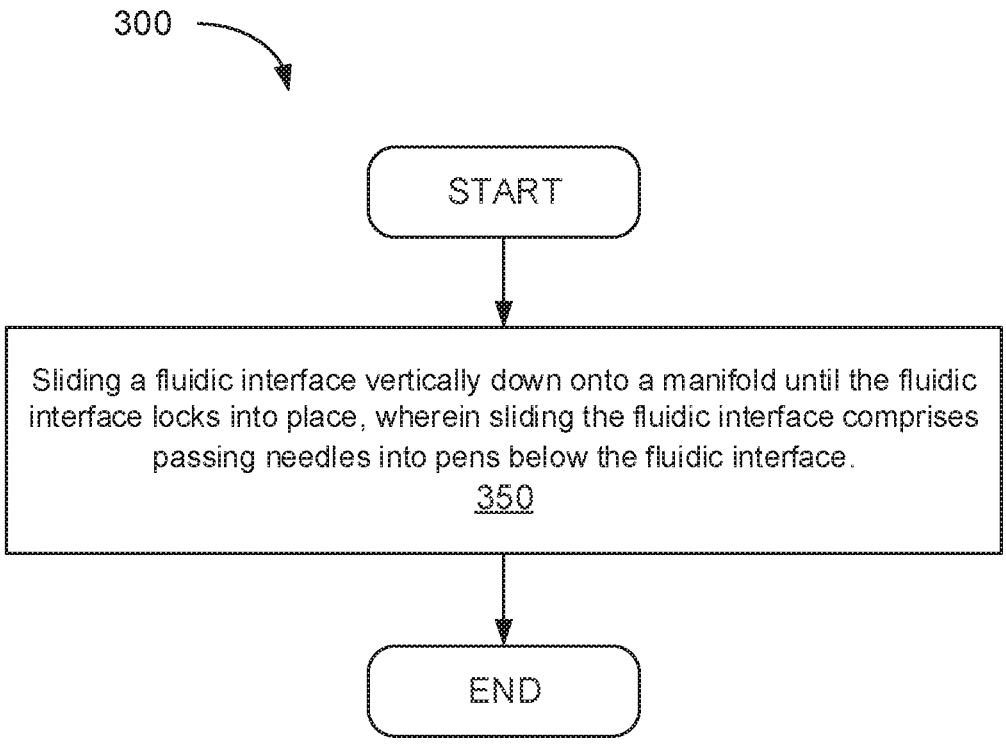
FIG. 3 shows a flowchart for an example method of preparing a Continuous Ink Supply System (CISS) ejector system for us consistent with this specification.

FIG. 3 shows a flowchart for an example method (300) consistent with this specification. The method (300) includes: sliding (350) a fluidic interface vertically down onto a manifold (100) until the fluidic interface locks into place, wherein sliding the fluidic interface includes passing needles into pens below the fluidic interface.

The method (300) includes sliding (350) the fluidic interface vertically onto the manifold (100). This action causes the needles to pass into the pens below the manifold (100) and below the fluidic interface. As the needles are traveling in a straight line in the direction of the needle, this results in a controlled opening in the pens to allow printing fluid to flow from reservoirs to the associated pens.

The method (300) may further include subsequently sliding the fluidic interface up, wherein sliding the fluidic interface up stops a flow of printing fluid to the ejector system. This may be desired during shipment of the system to a customer. Blocking the fluid flow may also be used in order to perform maintenance on the printing system and/or to clear a paper jam.

The method (300) may further include inserting a pen into the ejector system underneath the manifold (100) and rotating the manifold (100) to close over the pen. This operation may be performed prior to sliding (350) the fluidic interface vertically down onto the manifold (100).

The method (300) may further include locking a latch to limit pivoting of the manifold (100) and hold the manifold (100) against the pen. This may be performed between loading the pen into the system and sliding (350) the fluidic interface vertically down onto the manifold (100).

Figure 4:
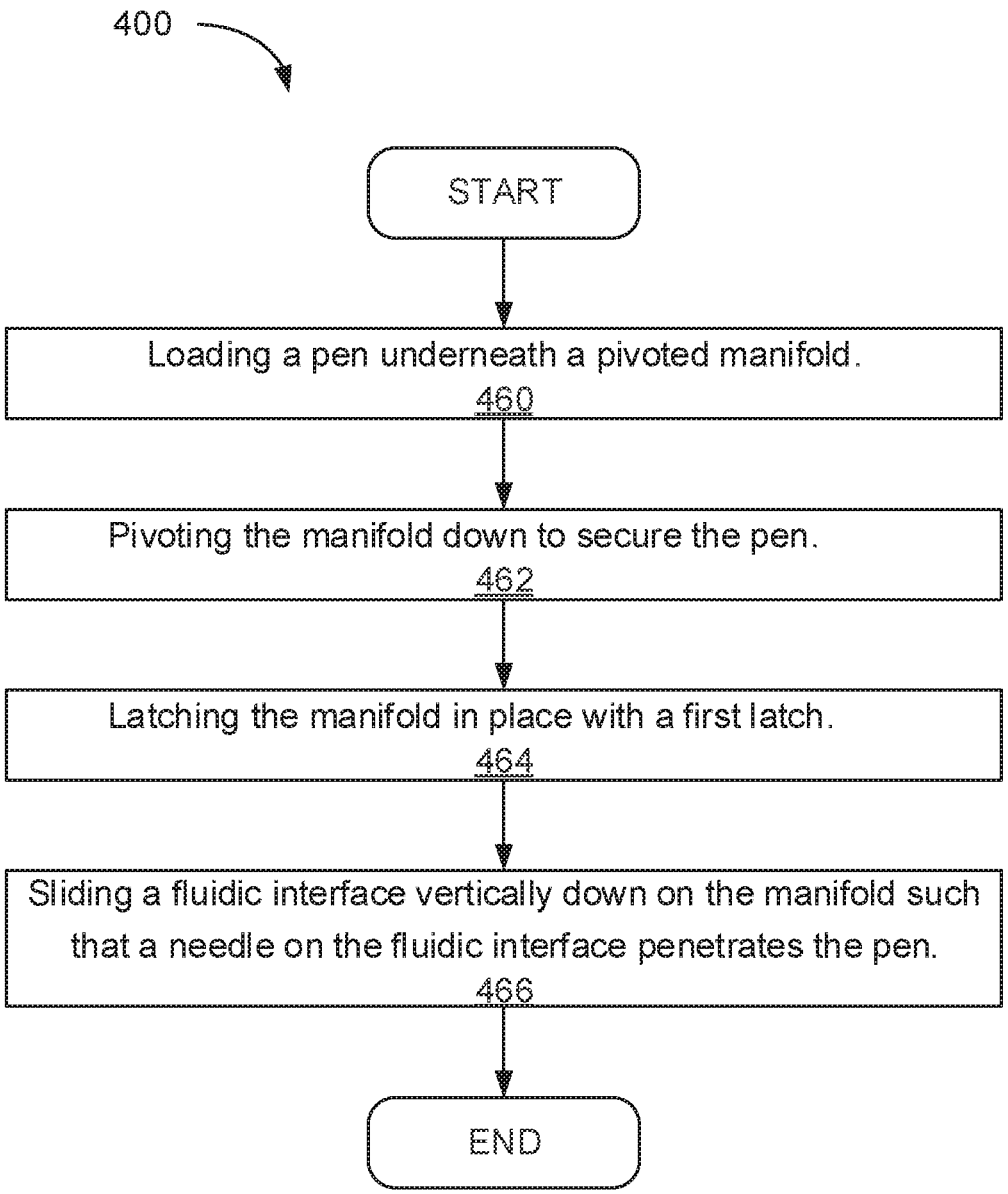
FIG. 4 shows a flowchart for an example method of preparing a CISS ejector system for use consistent with this specification.

FIG. 4 shows a flowchart for an example method (400) of preparing a CISS ejector system for use consistent with this specification. The method (400) includes loading (460) a pen underneath a pivoted manifold (100). This may include loading multiple pens underneath the pivoted manifold (100). Loading (406) the pen may include moving the pen into position laterally and then seating the pen vertically into the ejector system. This approach of lateral centering and vertical seating may minimize the depth of the system. Such an approach also allows a user to look down on the pen during loading which allows a user to visually inspect and ensure proper loading of the pen. In other examples, the pen is loaded nearly vertically with minimal Y-axis motion. The rotating manifold (100) as described herein allows the needed space to access the pen positions under the manifold (100) while simplifying the loading procedure. The result is that the system may be less deep (Y-axis) than a different system without such a rotating manifold (100). For instance systems with front insertion of the pens.

The method (400) includes pivoting (462) the manifold (100) down to secure the pen. The manifold (100) pivots on a rotational connector (110). The manifold (100) serves to hold the pen in place.

The method (400) includes latching (464) the manifold (100) in place with a first latch (250-1). The latching (464) of the manifold (100) may occur automatically when the manifold is rotated into position. In some examples, the latching (464) of the manifold (100) may include user manipulation of the latch (250).

The method (400) includes sliding (466) a fluidic interface vertically down on the manifold (100) such that a needle on the fluidic interface penetrates the pen. Sliding the fluidic interface linearly and vertically down on the manifold (100) allows the needle to penetrate the pen while creating a small hold in the pen. Smaller holes are less prone to weeping and other issues.

The method (400) may further include latching the fluidic interface to the manifold (100) with a second latch (240-2). The second latch (240-2) may latch automatically when the fluidic interface is in place. The second latch (250-2) may be manipulated by a user once the fluidic interface is in place in order to activate the second latch (250-2).

The method (400) may further include unlatching the first latch (240-1) and second latch (240-2) by actuating a release for the first latch (240-1). In some examples, the release for the first latch (240-1) automatically releases the second latch (240-2) prior to releasing the first latch (240-1). The second latch (240-2) may be released without releasing the first latch (240-1). This avoids a user attempting to rotate the manifold (100) without releasing the second latch (240-2) and causing larger holes in the pens.

Figure 5:
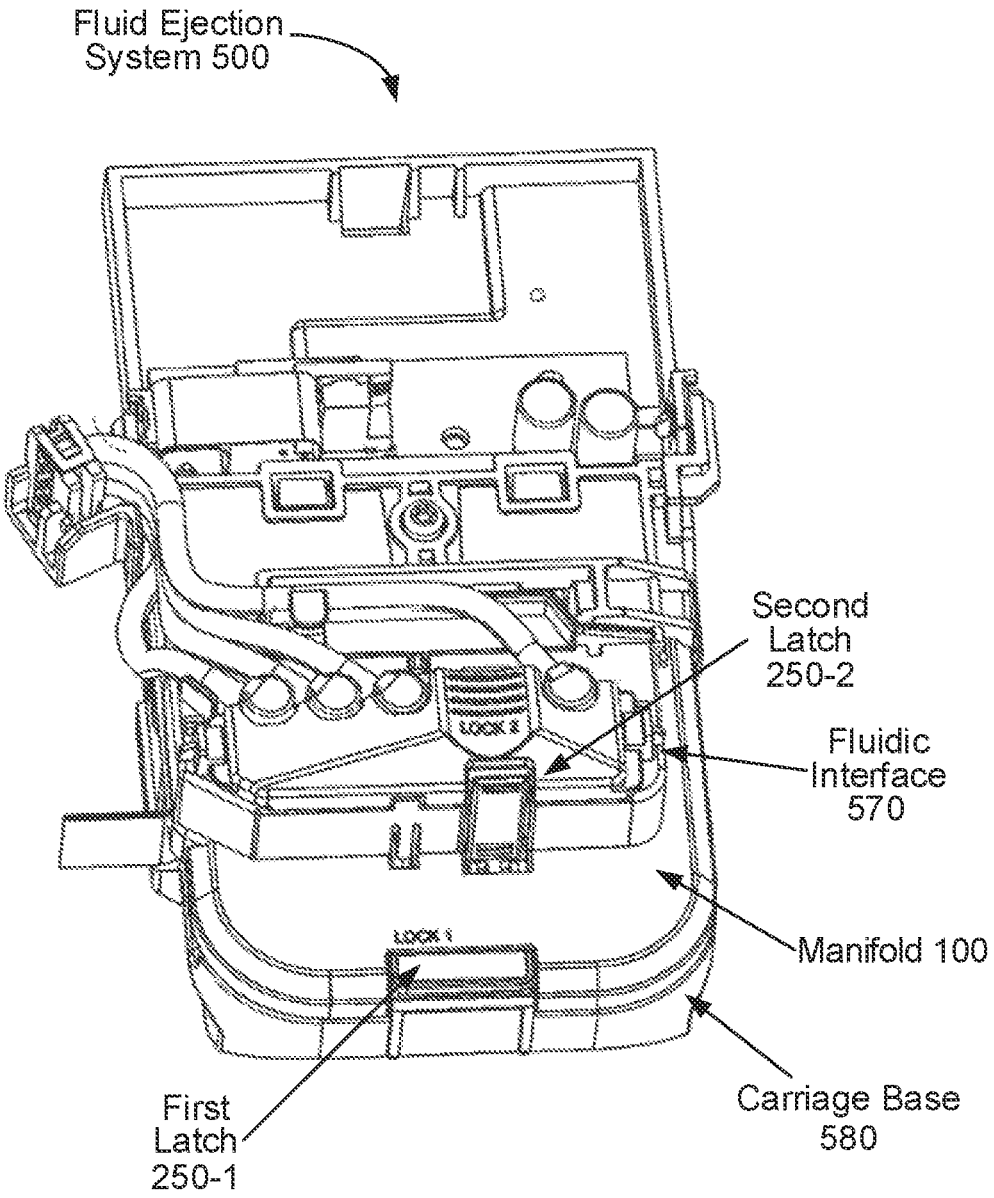
FIG. 5 shows a view of an example of a fluid ejection system with the manifold and fluidic interface in place in an example consistent with this specification.

FIG. 5 shows a view of an example fluid ejection system (500) with the manifold (100) and fluidic interface (570) in place in an example consistent with this specification. The fluidic interface (570) is mounted on top of the manifold (100). The manifold (100) rests on the carriage base (580). The fluidic interface (570) includes a number of tubes connecting the pens to the associated reservoirs (not shown). FIG. 5 also depicts the first latch (250-1) and the second latch (250-2) which secure the manifold (100) to the carriage base (580) and the fluidic interface (570) onto the manifold (100), respectively.

Figure 6:
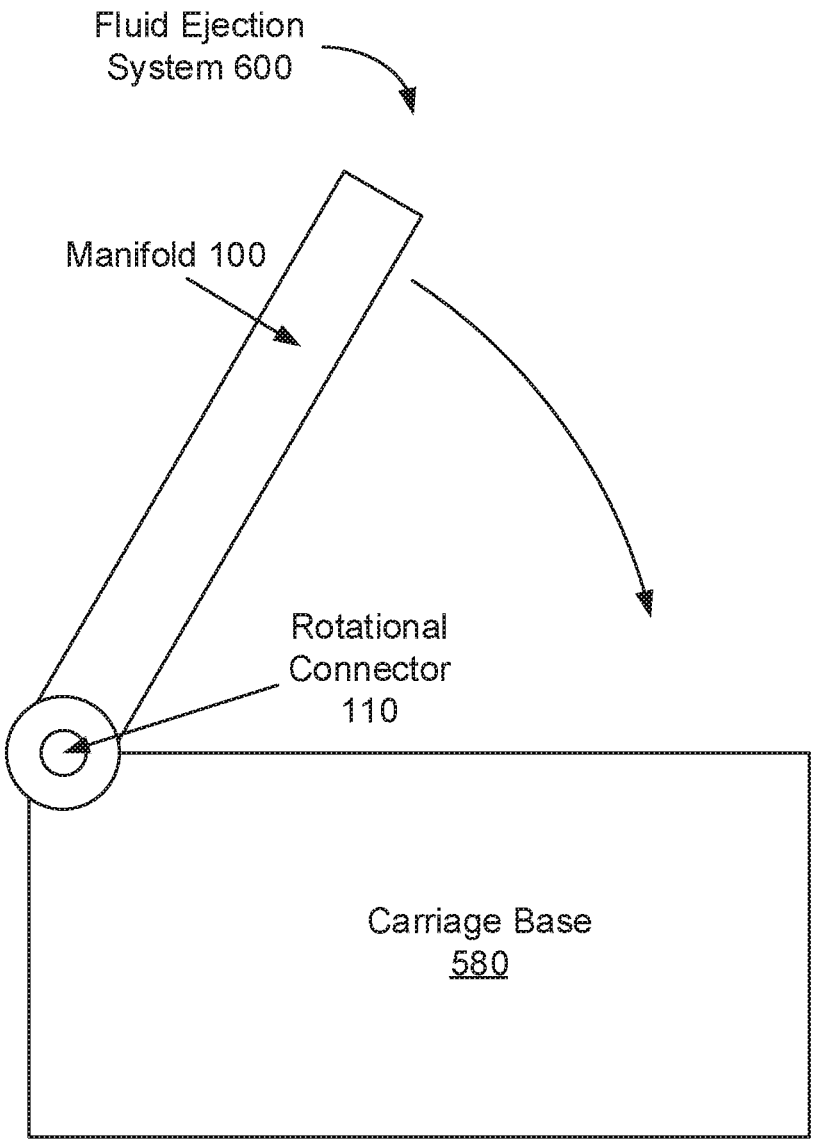
FIG. 6 shows a profile view of an example fluid ejection system consistent with this specification.

FIG. 6 shows a profile view of an example fluid ejection system (600) consistent with this specification. As described above, the manifold (100) is connected to the carriage base (580) by the rotational connector (110) and is able to rotate relative to the carriage base (580). This allows the manifold (100) to open up and pens to be placed under the manifold (100) in the carriage base (580). The pens may be placed in the carriage base (580) with minimal and/or no depth motion (Y-axis motion) allowing a narrow depth for the system (600) and the use of positioning springs for the X-axis and Z-axis for the pens.

Figure 7:
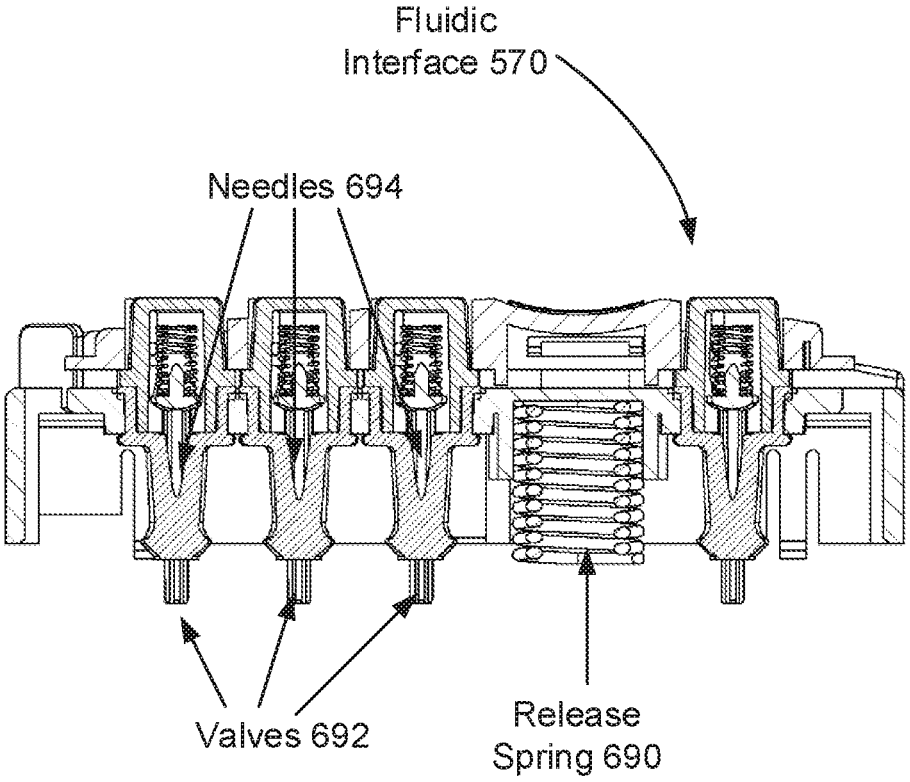
FIG. 7 shows a cross-sectional view of an example fluidic interface in an example consistent with this specification.

FIG. 7 shows a cross-sectional view of the fluidic interface (570) in an example consistent with this specification. The fluidic interface (570) includes a second release spring (690) which pushes the fluidic interface (570) away from the manifold (100) when the second latch (240-2) is released. A similar first release spring (690) may be associated with the first latch (240-1). Also visible are the needles (694) which extend out below the valves (692) to penetrate the pens below the fluidic interface (570). The needles (694) may then be retracted to allow printing fluid to flow through the valves (692). When the second latch (240-2) is released, the printing needles (694) seal the respective valves (692) to reduce and/or prevent leakage of the printing fluid. This allows the assembly, for example, to be shipped to a customer after the pens are installed at a distributor without leakage or similar issues.

Figure 8:
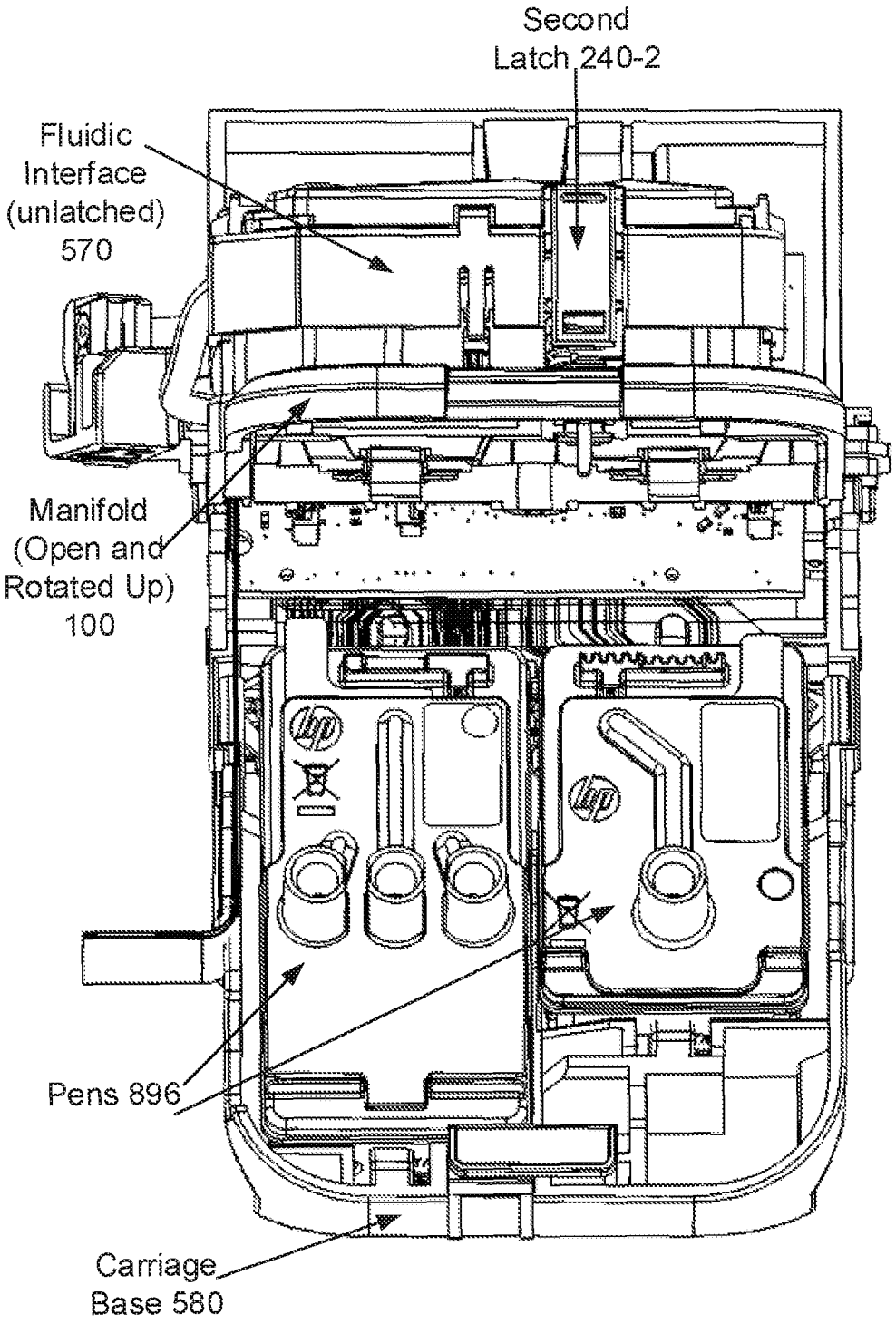
FIG. 8 shows a top view of an example carriage base with the manifold and fluidic interface rotated upward.

FIG. 8 shows a top view of an example carriage base (580) with the manifold (100) and fluidic interface (570) rotated upward and out of the way. The pens (896) are visible on the carriage base (580). The rotation of the manifold (100) provides easy access to the pens and allows loading the pens to be readily accomplished. The fluidic interface (570) is resting on the sliding surface (130) of the manifold (100) but is not latched in place. Once the manifold (100) is rotated down over the pens (896), the fluidic interface (570) may be slid down onto the manifold (100) and latched with the second latch (240-2).

Figure 9A:
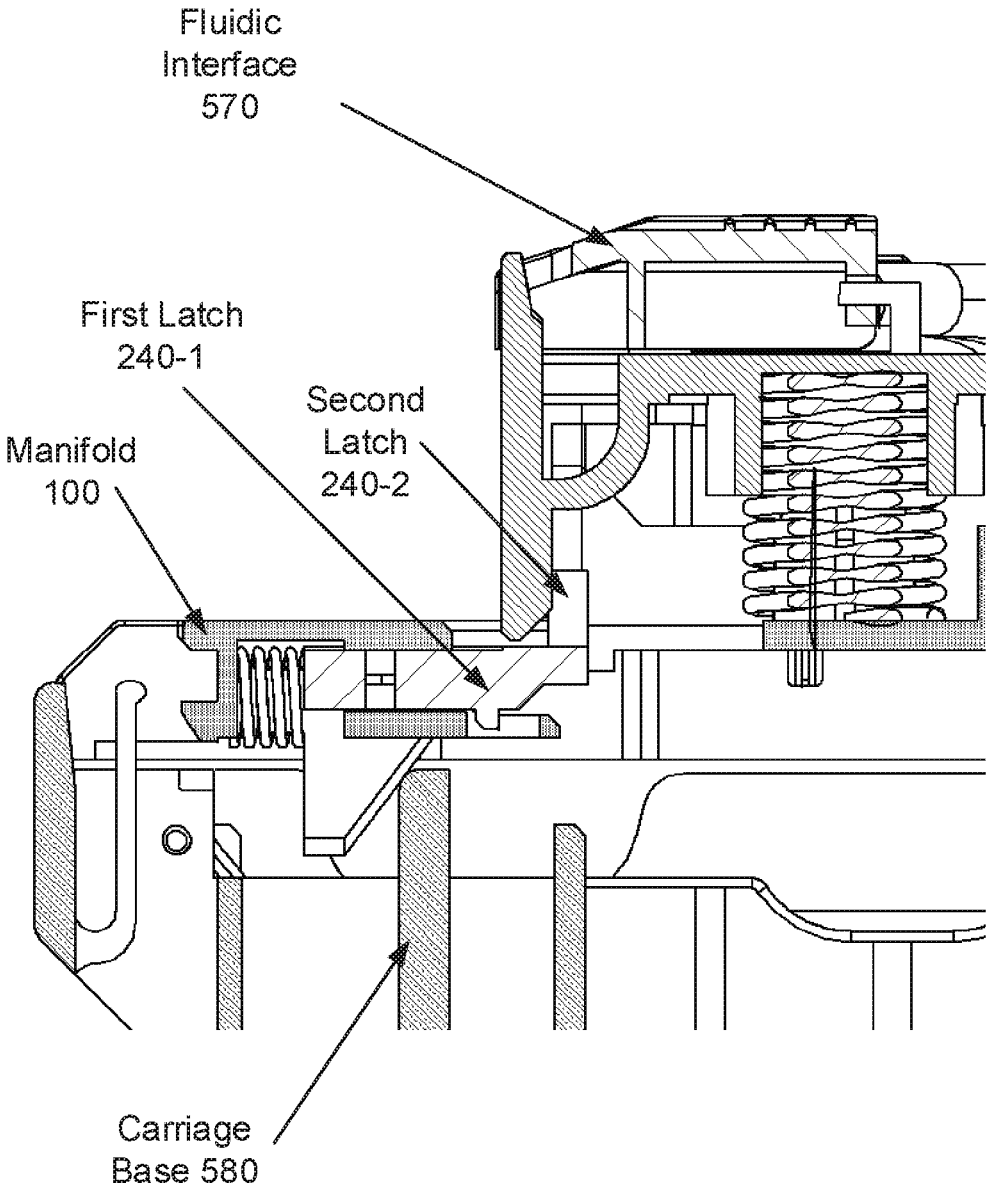
FIG. 9A shows an example system for unlatching a manifold.

FIG. 9A shows an example system (900) for unlatching a manifold (100). The system includes: a carriage base (580); the manifold (100) attached to the carriage base (580) by a first latch (240-1); a fluidic interface (570) connected to the manifold (100) by a second latch (240-2), wherein actuating a release for the first latch (240-1) releases the second latch (240-2) prior to releasing the first latch (240-1).

The system (900) may further include a first spring (998-1) wherein the first spring separates the manifold (100) from the carriage base (570) when the first latch (240-1) is released. The system (900) may further include a second spring, wherein actuating a release for the second latch (240-2) separates the fluidic interface (570) from the manifold (100). The manifold (100) may be connected to the carriage base (570) with a rotational connector (110).

Figure 9B:
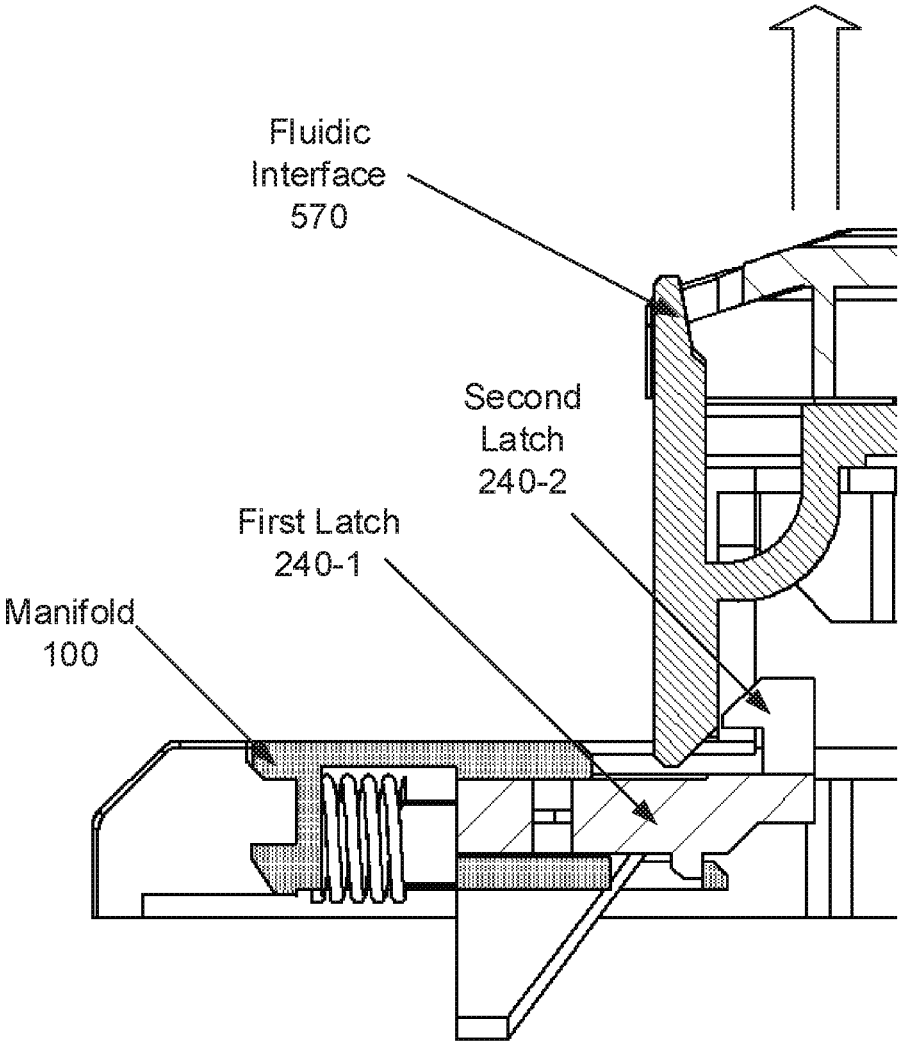
FIG. 9B shows the system of FIG. 9A with the first and second latches in release position.

FIG. 9B shows the system (900) of FIG. 9A with the first and second latches (240) in release position. The second latch (240-2) is now clear and the fluidic interface (570) is free to move upwards by the spring. The first latch (240-1) is also clear of its constraint and the manifold (100) is free to rotate on the rotational connector (110).

It will be appreciated that, within the principles described by this specification, a vast number of variations exist. It should also be appreciated that the examples described are only examples, and are not intended to limit the scope, applicability, or construction of the claims in any way.

What is claimed is:

1. A manifold for a fluid ejection system, the manifold comprising:

a rotational connector on a first side surface of the manifold, wherein the manifold is coupled to a carriage base at the rotational connector;

a plurality of pen interconnects on a bottom surface of the manifold; and a sliding surface on a top surface of the manifold, the sliding surface to accommodate a fluidic interface, wherein sliding the fluidic interface along the sliding surface extends needles from the fluidic interface through the plurality of pen interconnects into a plurality of pens.

2. The manifold of claim 1, further comprising a first latch to attach the manifold to the carriage base and maintain the manifold in position during use.

3. The manifold of claim 2, further comprising a second latch, wherein the second latch attaches and retains the fluidic interface against the manifold.

4. The manifold of claim 3, wherein unlatching the first latch allows the manifold to move about the rotational connector and unlatching the second latch allows the fluidic interface to separate from the manifold.

5. The manifold of claim 2, wherein unlatching the first latch automatically releases the second latch.

6. The manifold of claim 2, wherein the first latch latches at a second side surface of the manifold opposite the first side surface and the rotational connector.

7. The manifold of claim 1, wherein the plurality of pen interconnects comprise four pen interconnects.

8. The manifold of claim 1, wherein the rotational connector is a pivot which comprises two pins extending from opposite sides of the manifold, the two pins sharing an axis of rotation.

9. The manifold of claim 1, wherein the rotational connector is a hinge.

10. The manifold of claim 9, wherein the is the hinge is a living hinge.

11. The manifold of claim 1, wherein the sliding surface comprises multiple surfaces including a corner to orient and limit the range of motion of the fluidic interface while sliding on the sliding surface.

12. The manifold of claim 1, wherein the rotational connector is a pivot which comprises a single pin extending from the manifold to form an axis of the rotation connector.

13. The manifold of claim 12, wherein the manifold includes a C-shaped connection or a U-shaped feature coupled to the single pin to pivot the manifold around the single pin.

14. A system for unlatching a manifold comprising:

a carriage base;

a rotational connector on a side surface of the manifold, wherein the manifold is attached to the carriage base by the rotational connector and a first latch; and a fluidic interface connected to the manifold by a second latch, wherein actuating a release for the first latch releases the second latch prior to releasing the first latch.

15. The system of claim 14, wherein the first latch further comprises a first spring wherein the first spring separates the manifold from the carriage base when the first latch is released.

16. The system of claim 14, wherein the second latch further comprises a second spring, wherein actuating a release for the second latch separates the fluidic interface from the manifold.

17. The system of claim 14, wherein the manifold is pivotable about the rotational connector.

18. A method of preparing a CIS S ejector system for use, comprising:

loading a pen underneath a pivoted manifold coupled to a carriage base and pivotable around a rotational connector located on a first side surface of the manifold;

pivoting the manifold down to secure the pen;

latching the manifold in place with a first latch; and sliding a fluidic interface vertically down on the manifold such that a needle on the fluidic interface penetrates the pen.

19. The method of claim 18, further comprising latching the fluidic interface to the manifold with a second latch.

20. The method of claim 19, further comprising unlatching the first latch and second latch by actuating a release for the first latch.

* * * * *